US008155551B2

(12) United States Patent
Verheijen et al.

(10) Patent No.: US 8,155,551 B2
(45) Date of Patent: Apr. 10, 2012

(54) POWER SUPPLY CONTROL METHOD AND APPARATUS

(75) Inventors: Hendrikus Adrianus Anthonius Verheijen, Helden (NL); Henricus Johannes Maria Reijnders, Venray (NL)

(73) Assignee: Xerox Corporation, Norwalk, CT (US)

( * ) Notice: Subject to any disclaimer, the term of this patent is extended or adjusted under 35 U.S.C. 154(b) by 424 days.

(21) Appl. No.: 12/492,549

(22) Filed: Jun. 26, 2009

(65) Prior Publication Data

US 2010/0329725 A1 Dec. 30, 2010

(51) Int. Cl.
*G03G 15/00* (2006.01)

(52) U.S. Cl. ..... 399/88; 399/37; 341/142; 323/283; 700/297; 700/298

(58) Field of Classification Search ..... 399/37, 399/88; 700/297, 298; 341/142; 323/283
See application file for complete search history.

(56) References Cited

U.S. PATENT DOCUMENTS

| | | | | |
|---|---|---|---|---|
| 4,545,669 | A | 10/1985 | Hays et al. | |
| 4,868,600 | A | 9/1989 | Hays et al. | |
| 5,172,170 | A | 12/1992 | Hays et al. | |
| 5,245,392 | A | 9/1993 | Behe et al. | |
| 5,289,240 | A | 2/1994 | Wayman | |
| 5,418,105 | A | 5/1995 | Wayman et al. | |
| 5,420,672 | A | 5/1995 | Brewington et al. | |
| 5,436,712 | A | 7/1995 | Wayman et al. | |
| RE35,698 | E | 12/1997 | Behe et al. | |
| 5,864,734 | A | 1/1999 | Lewis et al. | |
| 5,943,539 | A | 8/1999 | Hirsch et al. | |
| 5,978,633 | A | 11/1999 | Hirsch et al. | |
| 6,101,357 | A | 8/2000 | Wayman | |
| 6,427,892 | B1 | 8/2002 | Reijnders | |
| 6,464,121 | B2 | 10/2002 | Reijnders | |
| 6,668,146 | B2 | 12/2003 | Folkins et al. | |
| 6,681,084 | B1 | 1/2004 | Reijnders | |
| 6,763,201 | B1 | 7/2004 | Reijnders | |
| 7,171,136 | B2 | 1/2007 | Wayman | |
| 7,197,268 | B2 | 3/2007 | Verheijen | |
| 7,263,316 | B1 | 8/2007 | Wayman et al. | |
| 7,411,406 | B2 | 8/2008 | Verheijen | |
| 7,419,084 | B2 | 9/2008 | Verheijen | |
| 2005/0275576 | A1* | 12/2005 | Fudge et al. | 341/155 |
| 2008/0082277 | A1* | 4/2008 | Holmquist et al. | 700/297 |
| 2009/0121908 | A1* | 5/2009 | Regier | 341/142 |
| 2009/0128114 | A1* | 5/2009 | Brown et al. | 323/283 |

* cited by examiner

*Primary Examiner* — Ryan Walsh
(74) *Attorney, Agent, or Firm* — Fay Sharpe LLP

(57) ABSTRACT

This disclosure provides power supply control methods and apparatus. According to one aspect of the disclosure, a method of operating a power supply operatively connected to a developer unit associated with a printing apparatus is disclosed. The method includes generating a modified output control signal as a function of stored gain and offset values associated with the power supply to generate a desired output voltage to drive the developer unit.

20 Claims, 8 Drawing Sheets

POWER SUPPLY CONTROL METHOD AND APPARATUS

BACKGROUND

This disclosure relates to power supply control methods and apparatus. Specifically, the exemplary embodiments described herein provide methods and apparatus to control the output of a power supply operatively connected to a xerographic printing developer unit for transferring toner to a photoreceptor belt for subsequent transfer to a media sheet.

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or non-interactive development systems.

Hybrid scavengeless development technology develops toner via a conventional magnetic brush onto the surface of a donor roll and a plurality of electrode wires are closely spaced from the toned donor roll in the development zone. An AC voltage is applied to the wires to generate a toner cloud in the development zone. This donor roll generally consists of a conductive core covered with a thin (50-200.mu.m) partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical ac voltages of the wires relative to the donor are 600-900 Vpp at frequencies of 5-15 kHz. These ac signals are often square waves, rather than pure sinusoidal waves. Toner from the cloud is then developed onto the nearby photoreceptor by fields created by a latent image.

To produce the AC and DC voltages necessary to transfer toner from a cloud, high voltage power supplies (HVPS) can be controlled to change the output level according to an analog input control voltage. The voltage of this input represents the desired output level according to a specified relationship. In the circuits that are converting the analog control voltage to the high voltage output level there will be inaccuracies. These inaccuracies cause deviation in the above-mentioned relationship and are different for each source and each single HVPS. Therefore, it can be necessary to do adjustments on each such source and with each single HVPS produced. To enable the adjustments, usually trimmer potentiometers are used. The adjustment procedure with potentiometers, which is usually performed in production, is labor intensive and operator dependant.

There exists a need for HVPS methods and apparatus which minimize the cost and/or labor necessary to calibrate high voltage power supplies.

INCORPORATION BY REFERENCE

U.S. Pat. No. 6,101,357, issued to Wayman on Aug. 8, 2000, entitled "Hybrid Scavengeless Development using a Method for Preventing Power Supply Induced Banding;"

U.S. Pat. No. 7,171,136, issued to Wayman on Jan. 30, 2007, entitled "Power Supply for Hybrid Scavengeless Development Type Image Forming System;" and U.S. Pat. No. 4,868,600 to Hays et al. on Sep. 19, 1989, entitled "Scavengeless Development Apparatus for use in Highlight Color Imaging" are all incorporated herein by reference in their entirety.

BRIEF DESCRIPTION

In one embodiment of this disclosure, a method of operating a power supply is disclosed. The method of operating the power supply includes an analog output control input, a respective analog output associated with the analog output control input, and a microcontroller, the microcontroller executing instructions to perform the method comprising: acquiring an analog output control signal from the analog output control input, the analog output control signal representing a predetermined analog output associated with the analog output control input; converting the analog output control signal to a digital output control signal; generating a modified digital output control signal as a function of stored gain and offset values associated with the power supply to generate the predetermined analog output; converting the modified digital output control signal to a modified analog output signal; and processing the modified analog output control signal to drive the power supply to generate the predetermined analog output for powering a device.

In another embodiment of this disclosure, a power supply is disclosed which comprises an analog output control input; a respective analog output associated with the analog output control input; and a microcontroller, the microcontroller configured to execute instructions to perform the method comprising acquiring an analog output control signal from the analog output control input, the analog output control signal representing a predetermined analog output associated with the analog output control input; converting the analog output control signal to a digital output control signal; generating a modified digital output control signal as a function of stored gain and offset values associated with the power supply to generate the predetermined analog output; converting the modified digital output control signal to a modified analog output signal; and processing the modified analog output control signal to drive the power supply to generate the predetermined analog output for powering a device.

In still another embodiment of this disclosure, a xerographic printing apparatus is disclosed which comprises a photo receptor; a ROS, the ROS configured to generate an electrostatic image on the photo receptor; a developer unit, the developer unit configured to transfer toner to the electrostatic image on the photo receptor; and a power supply operatively connected to the developer unit, wherein the power supply is configured to supply a range of voltages to the developer unit to transfer the toner to the photo receptor, and the power supply includes an analog output control input, a respective analog output associated with the analog output control input, and a microcontroller, the microcontroller configured to execute instructions to perform the method comprising: acquiring an analog output control signal from the analog output control input, the analog output control signal representing a predetermined analog output associated with the analog output control input; converting the analog output control signal to a digital output control signal; generating a modified digital output control signal as a function of stored gain and offset values associated with the power supply to generate the predetermined analog output; converting the modified digital output control signal to a modified analog output signal; and processing the modified analog output control signal to drive the power supply to generate the predetermined analog output for powering a device.

DETAILED DESCRIPTION

Figure 1:
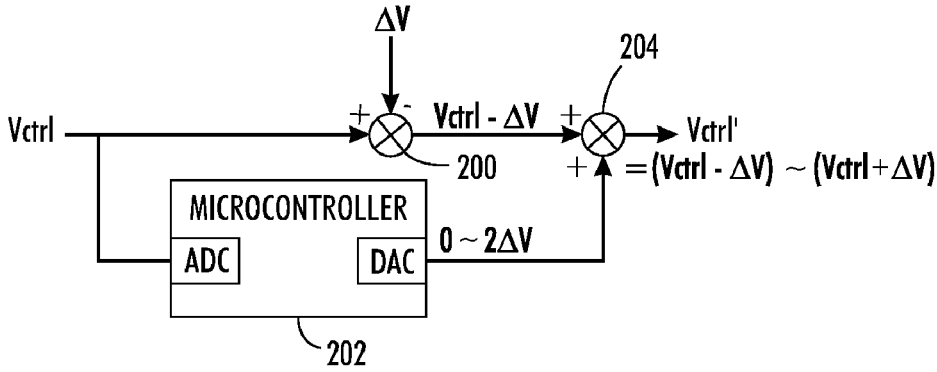
FIG. 1 is a schematical representation of the power supply section that modifies the analog output control signal including one output according to an exemplary embodiment of this disclosure.

This disclosure and the exemplary embodiments provided herein, provide methods and apparatus for controlling the output of a power supply. According to the exemplary embodiments described, a HVPS, operatively connected to a developer unit, is controlled to generate the necessary voltages for producing and transferring toner to a PR (photo receptor) belt or drum. However, the voltage control methods and apparatus are not limited to a printing device and can be applied to any device which requires a specific input voltage based on a specific control voltage.

Substantively, this disclosure provides a HVPS control method which utilizes a microcontroller as part of the HVPS to calculate a required gain and offset correction relative to an input control voltage. The HVPS can be connected with automatic adjustment equipment in a production environment to calculate the corrections and the microcontroller non-volatile memory can be used to store the corrections. In operating mode, the HVPS accesses the corrections to accurately generate an output voltage based on a predetermined input control voltage. This automatic method enables good process control, adjustment logging, high accuracy and adjustment protection. In addition, the disclosed embodiments provide a non-mechanical solution to maintaining HVPS variations within acceptable limits.

Provided below is a more detailed description of the current limitations associated with a HVPS and an analysis of the operation of an HVPS. The analysis and conclusions provided form a basis for the disclosed technology and exemplary embodiments provided herein.

Some high voltage power supplies are equipped with several high voltage output sources. There can be a requirement for each source to be independently and dynamically changed in output level. Such a DC or AC source can be a constant voltage or constant current type of source. An example is a high voltage power supply (HVPS) for a hybrid scavengeless development unit, which is equipped with 8 of such sources: 5 DC and 3 AC constant voltage sources. One common way, also used for the HVPS, to change the output level of a source is to use an analog control voltage as input. The voltage of this input represents the desired output level according to a specified relationship.

In the circuits that are converting the analog control voltage to the high voltage output level there will be inaccuracies. These inaccuracies cause deviations in the above-mentioned relationship and are different for each source and each single HVPS. Therefore, it can be necessary to do adjustments on each such source and with each single HVPS produced. To enable the adjustments, usually trimmer potentiometers are used.

In a lot of cases the inaccuracies in HVPS units are not the result of non-linearity, but are mainly caused by tolerances in resistors and reference voltages. Other contributors can be operational amplifier offset voltages and bias currents. In general, the specified relationship between control voltage and output level is of the form $$Vout=gain\times Vctrl+Vos,$$

or in case of a constant current source $$Iout=gain\times Vctrl+Ios, \text{ where}$$

Vctrl is the control voltage applied to the HVPS input;
Vos is the offset voltage, Ios the offset current and both may be specified as zero.

The gain factor is called gain. In case of a constant current source gain has the unit $\Omega^{-1}$ as it is a trans-conductance The above mentioned tolerances and non-ideal operational amplifier parameters will not change the form of the relationship, but will result in different values of gain and Vos or Ios.

For a voltage source this can be expressed as $$Vout=(gain+\Delta gain)\times Vctrl+(Vos+\Delta Vos).$$

It is to be understood a current source will only use different parameter names, relative to a voltage source. Accordingly, this disclosure primarily describes the disclosed embodiments in terms of a voltage source, however, they are applicable to current sources as well.

The adjustment procedure should find the values Δgain and ΔVos. When trimmer potentiometers are used, there will be one for gain and one for offset correction. This procedure is complicated by the fact that the gain portion and offset portion of the correction has to be distinguished. In order to find the correct settings of these trimmer potentiometers a labor intensive, iterative procedure is required that uses two different control voltage settings. Each iteration will further approximate Δgain and ΔVos. The procedure is operator dependant and therefore may have a negative effect on process control.

The disclosed HVPS control methods and apparatus operating principles are now described below.

The equation $$Vout=(gain+\Delta gain)\times Vctrl+(Vos+\times Vos) \quad (1)$$

can be written as $$Vout=gain\times Vctrl+\Delta gain\times Vctrl+Vos+\Delta Vos. \quad (2)$$

Suppose that a control voltage Vctrl' is required to obtain the correct output level with the specified gain and offset.

$$Vout=gain\times Vctrl'+Vos. \quad (3)$$

When equations (2) and (3) are combined to eliminate Vout, the following equation is the result:

$$Vctrl'=Vctrl\times(1+\Delta gain/gain)+\Delta Vos/gain. \quad (4)$$

Based on equation (4), it is clear that the relationship between Vctrl' and Vctrl also has a gain and offset component. The gain equals (1+Δgain/gain), and the offset equals ΔVos/gain. So alternatively, Vctrl' can be written as:

$$Vctrl'=Vctrl\times gain_{vctl}+Vos_{Vctrl} \quad (5)$$

or $$Vctrl'=Vctrl\times(1+gain_{Vctrl}+Vos_{Vctrl}. \quad (6)$$

Equation (6) shows how the required adjustment can be done through a gain and offset correction of the control voltage. This disclosure and the exemplary embodiments included herein make use of this property.

Assuming a microcontroller has the values $\Delta gain_{Vctrl}$ and $Vos_{Vctrl}$ of a certain output stored in its memory. Then it is possible to read the momentary control voltage Vctrl with an analog to digital converter (ADC), make calculation (6) and to write the result to a digital to analog converter (DAC). The result can then be used to drive the HVPS circuitry in order to generate the requested output level. The microcontroller can perform these operations in a continuous repeating loop or on an interrupt basis.

FIG. 1 illustrates the hardware implementation according to one exemplary embodiment. It consists of a microcontroller 202 with integrated ADC and DAC. The addition and subtraction operations are done with standard operational amplifier topologies 200 and 204. In the example of FIG. 1, it is possible to adjust +/−ΔV around the control voltage Vctrl but any other adjustment band can be selected.

Figure 2:
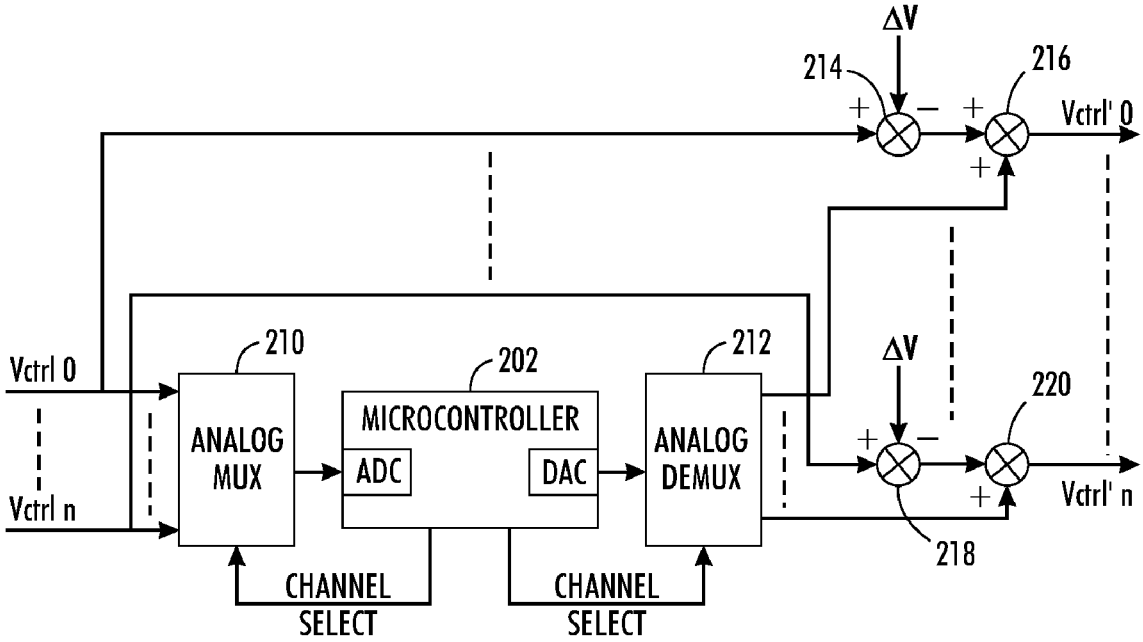
FIG. 2 is a schematical representation of a multi-input, multi— output power supply section that modifies the multiple analog output control signals according to an exemplary embodiment of this disclosure.

As mentioned above, this method relies on the correct values $\Delta gain_{Vctrl}$ and $Vos_{Vctrl}$ stored in the non-volatile memory (NVM) of the microcontroller 202. For multiple outputs a multiplexing technique can be utilized, as shown in FIG. 2, which includes an analog MUX 210, a micro controller 202, an analog DEMUX 212 and standard operational amplifier topologies 214, 216, 218 and 220.

Figure 3:
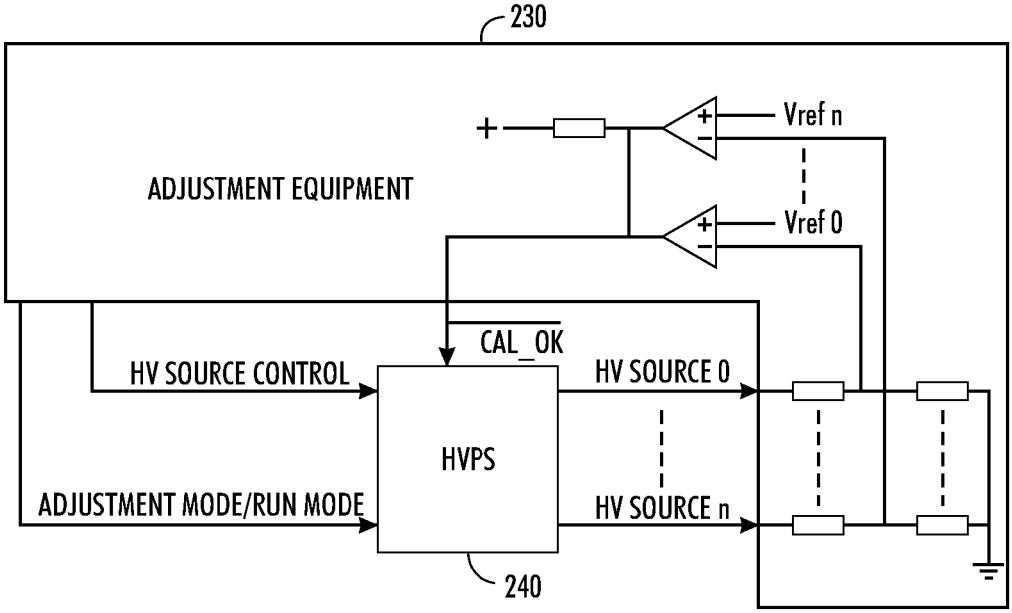
FIG. 3 is a schematical representation of a power supply calibration fixture according to an exemplary embodiment of this disclosure.

Now follows a discussion of a method to effectively determine the values $\Delta gain_{Vctrl}$ and $Vos_{Vctrl}$. Note that, similar to the trimmer potentiometers adjustments, these values are determined and stored in NVM in the HVPS production environment, in the final stage of the production process. The below described method requires automatic adjustment equipment that may be part of the production final test equipment. It is illustrated in FIG. 3.

Since equation (6) is a first order equation, we need to know Vctrl' for two different Vctrl settings to be able to calculate $\Delta gain_{Vctrl}$ and $Vos_{Vctrl}$.

Figure 4:
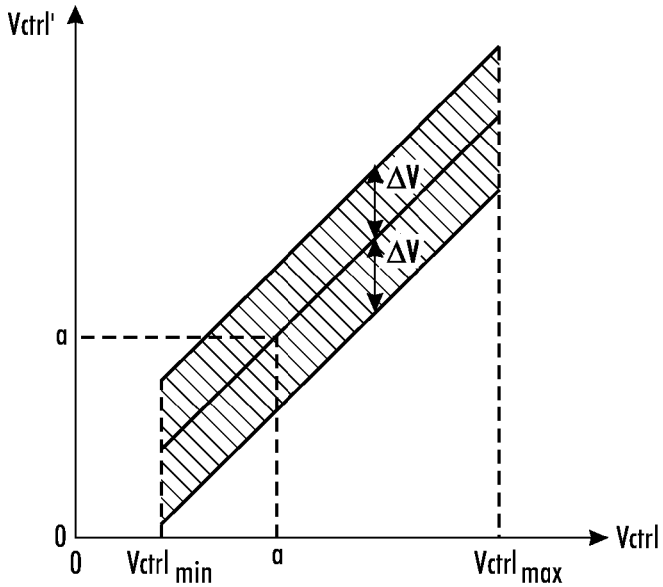
FIG. 4 is a graph which is a graphical representation of Vctrl'=f (Vctrl).

In order to find the two Vctrl' values, the microcontroller is first put in an adjustment mode and the output source to be adjusted is switched on. In this mode, for a given control voltage Vctrl, the microcontroller will gradually vary Vctrl' within the adjustment band. This will also vary the output voltage of the concerning source. Graph 1 illustrated in FIG. 4 shows the adjustment band.

The lower threshold of the adjustment band is the minimum attainable voltage of Vctrl'. It should be at least as low as the Vctrl' voltage required for the lowest $\Delta gain_{Vctrl}$ and lowest $Vos_{Vctrl}$ possible. In general, and in the example of FIG. 1 and Graph 1, both minimum values are negative.

The upper threshold of the adjustment band is the maximum attainable voltage of Vctrl'. It should be at least as high as the Vctrl' voltage required for the highest $\Delta gain_{Vctrl}$ and highest $Vos_{Vctrl}$ possible. In general, and in the example of FIG. 1 and Graph 1, both maximum values are positive.

As the microcontroller is gradually varying the Vctrl' voltage, the adjustment equipment, where the HVPS is connected with, can measure the concerning output voltage and send a signal (CAL_OK) to the microcontroller instantaneously when the desired voltage is reached. The microcontroller can store the digital number associated with the Vctrl' voltage, which was generated when CAL_OK was activated. This digital number determines one point in the shaded area of Graph 1 of FIG. 4.

While still in adjustment mode, the microcontroller can vary the output voltage of the same source a second time but based on another Vctrl voltage. The same procedure is repeated and results in a second digital number and second point in the shaded area of Graph 1 of FIG. 4. The relationship between Vctrl and Vctrl' is represented by a straight line going through the two points found. With the two digital numbers the microcontroller can calculate $\Delta gain_{Vctrl}$ and $Vos_{Vctrl}$. After storing $\Delta gain_{Vctrl}$ and $Vos_{Vctrl}$ in NVM the adjustment mode will be concluded.

The highest accuracy will be obtained when the two Vctrl voltages used for the adjustment are at their extremes. It should also be noted that the accuracy fully relies on the measurement accuracy of the output voltage carried out by the adjustment equipment.

A few additional notes:

In case the control voltage (Vctrl) is generated by a DAC, the resolution (expressed in bits) of the DAC in FIG. 1 can be lower. This is because the DAC in FIG. 1 requires less quantization levels to obtain the same voltage resolution: only a portion (2ΔV in this example) needs to be quantized instead of the whole control voltage range. The bit resolution of the ADC in FIG. 1 should be preferably at least equal to the bit resolution of the DAC used for the control voltage generation. A lower bit resolution will make the adjustment less accurate.

The required sample rate and calculation speed depends on the desired dynamic behavior (rise/fall time, settling time) of the outputs. However, in general only a small portion of the output level is affected (+/−ΔV) and as a result the effect on the dynamic behavior is very limited. This means that the sample rate and calculation speed can be very low and therefore the hardware is not critical.

This disclosure describes a method for correcting deviations inside one output circuit. However, when one output has an unwanted influence on another output, the described hardware is also suitable for compensating such a cross-influence. The calculations to be performed by the microcontroller are similar.

Notably, as previously discussed in the background section, the common method of adjusting with trimmer potentiometers has a number of disadvantages:

- Labor intensive (especially if both offset and gain should be adjusted).
- Operator dependant, so critical for process control.
- High quality (multi-turn) trimmer potentiometers are expensive.
- Trimmer potentiometers are electro-mechanical components, so mechanical effects like vibration or shock can change the settings.
- Anyone who has access to the potentiometers can easily change the adjustments.

The described embodiments attempts to minimize these disadvantages. It is an automated low-cost solution and results in a very low HVPS-to-HVPS adjustment variation. Other potential advantages are:

- Enables logging of all adjustments made. The logged results can be used for product optimization.
- The microcontroller can be used for other HVPS tasks as well.

Figure 5:
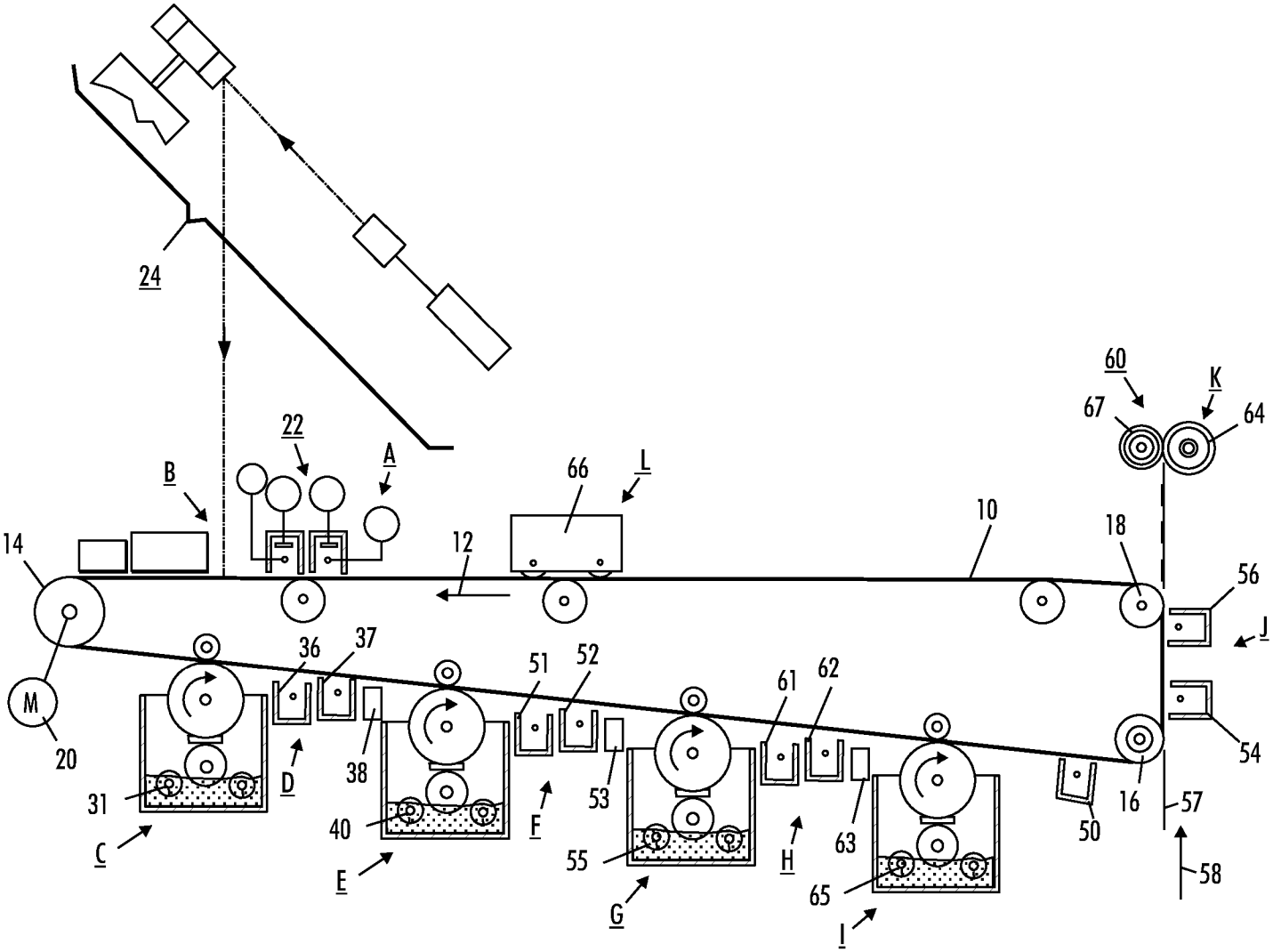
FIG. 5 is a schematical representation of a printing apparatus including developer units which are operatively connected to a plurality of power supplies according to this disclosure.

Referring to FIG. 5, there is shown an illustrative electrophotographic machine having incorporated therein a development apparatus powered by a power supply according to the present disclosure. The electrophotographic printing machine creates a color image in a single pass through the machine. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images that, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential. The image area has a uniform potential of about −500 volts. In practice, this is accomplished by charging the image area slightly more negative than −500 volts so that any resulting dark decay reduces the voltage to the desired −500 volts. While the image area is described as being negatively charged, it could be positively charged if the charge levels and polarities of the toners, recharging devices, photoreceptor, and other relevant regions or devices are appropriately changed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser-based output scanning device 24 as a light source, it is to be understood that other light sources, for example an LED printbar, can also be used with the principles of the present invention. The voltage level, about −500 volts, exists on those parts of the image area which were not illuminated, while the voltage level, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area. It should be understood that one could also use positively charged toner if the exposed and unexposed areas of the photoreceptor are interchanged, or if the charging polarity of the photoreceptor is made positive.

Figure 6:
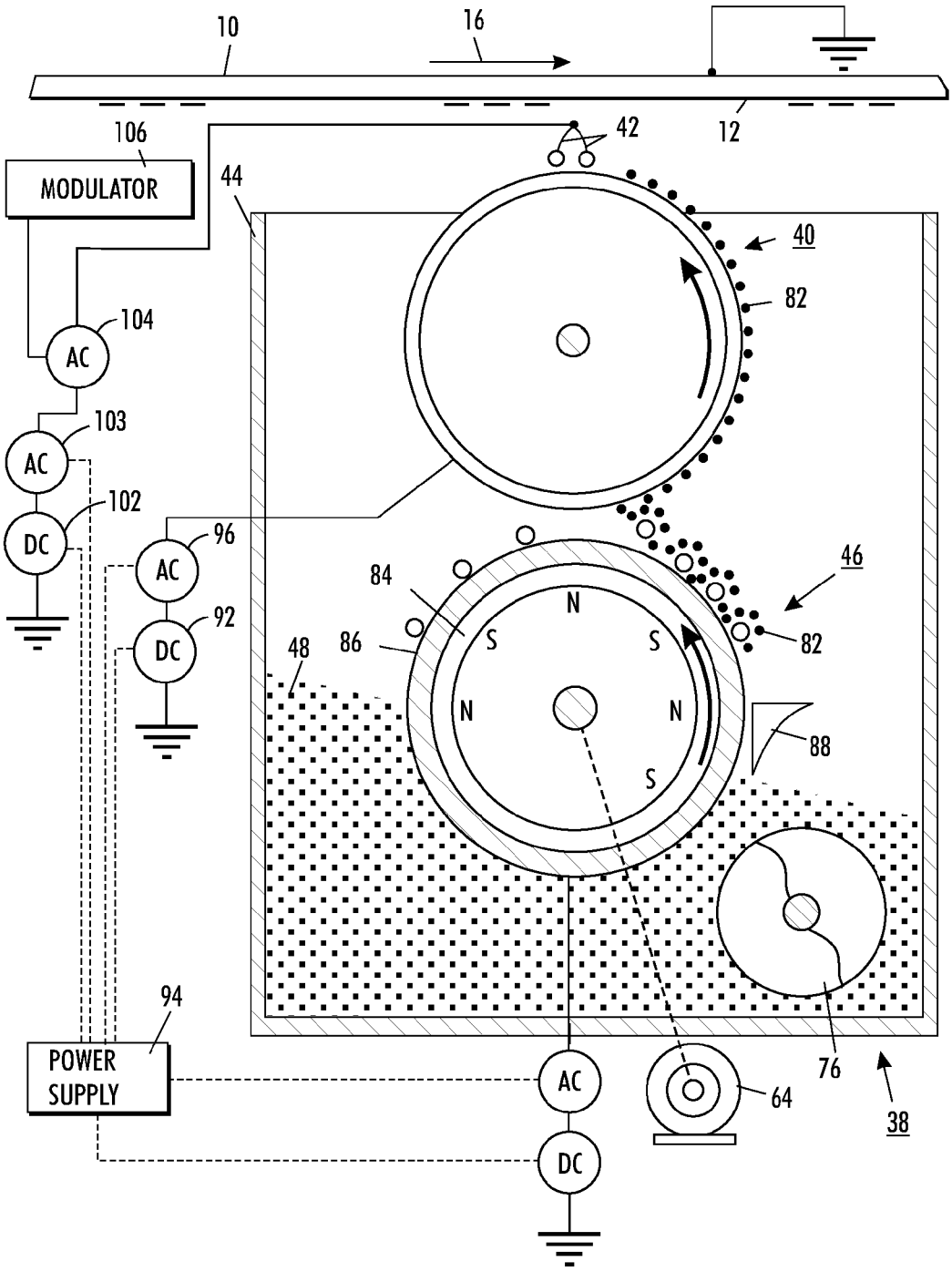
FIG. 6 is a schematical representation of a developer unit and associated power supply according to an exemplary embodiment of this disclosure.

For the first development station C, development system includes a donor roll. As illustrated in FIG. 6, electrode grid 42 is electrically biased with an AC voltage relative to doner roll 40 for the purpose of detaching toner therefrom. This detached toner forms a toner powder cloud in the gap between the donor roll and photoconductive surface. Both electrode grid 42 and donor roll 40 are biased with DC sources 102 and 92 respectively for discharge area development (DAD). The discharged photoreceptor image attracts toner particles from the toner powder cloud to form a toner powder image thereon.

Toner 76 (which generally represents any color of toner) adheres to the illuminated image area. This causes the voltage in the illuminated area to increase to, for example, about −200 volts. The unilluminated parts of the image area remain at about the level −500 72.

Referring back to FIG. 5, after passing through the first development station C, the now exposed and toned image area passes to a first recharging station D. The recharging station D is comprised of two corona recharging devices, a first recharging device 36 and a second recharging device 37. These devices act together to recharge the voltage levels of both the toned and untoned parts of the image area to a substantially uniform level. It is to be understood that power supplies are coupled to the first and second recharging devices 36 and 37, and to any grid or other voltage control surface associated therewith, so that the necessary electrical inputs are available for the recharging devices to accomplish their task.

The first recharging device overcharges the image area to more negative levels than that which the image area is to have when it leaves the recharging station D. For example, the toned and the untoned parts of the image area, reach a voltage level of about −700 volts. The first recharging device 36 is preferably a DC scorotron.

After being recharged by the first recharging device 36, the image area passes to the second recharging device 37. The second recharging device 37 reduces the voltage of the image area, both the untoned parts and the toned parts (represented by toner 76) to a level which is the desired potential of −500 volts.

After being recharged at the first recharging station D, the now substantially uniformly charged image area with its first toner powder image passes to a second exposure station 38.

Except for the fact that the second exposure station illuminates the image area with a light representation of a second color image (say yellow) to create a second electrostatic latent image, the second exposure station 38 is the same as the first exposure station B. The non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 57 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the support sheet 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 6 in greater detail, development system 38 includes a donor roll 40. A development apparatus advances developer materials into development zones. The development system 38 is scavengeless. By scavengeless is meant that the developer or toner of system 38 must not interact with an image already formed on the image receiver. Thus, the system 38 is also known as a non-interactive development system. The development system 38 comprises a donor structure in the form of a roller 40. The donor structure 40 conveys a toner layer to the development zone which is the area between the member 10 and the donor structure 40. The toner layer 82 can be formed on the donor 40 by either a two-component developer (i.e. toner and carrier), as shown in FIG. 6, or a single-component developer deposited on member 40 via a combination single-component toner metering and charging device. The development zone contains an AC biased electrode structure 42 self-spaced from the donor roll 40 by the toner layer. The single— component toner may comprise positively or negatively charged toner. For donor roll loading with two-component developer, a conventional magnetic brush 46 is used for depositing the toner layer onto the donor structure. The magnetic brush includes a magnetic core enclosed by a sleeve 86.

With continued reference to FIG. 6, auger 76, is located in housing 44. Auger 76 is mounted rotatably to mix and transport developer material. The augers have blades extending spirally outwardly from a shaft. The blades are designed to advance the developer material in the axial direction substantially parallel to the longitudinal axis of the shaft. The developer metering device is designated 88. As successive electrostatic latent images are developed, the toner particles within the developer material are depleted. A toner dispenser (not shown) stores a supply of toner particles. The toner dispenser is in communication with housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are maintained in the chamber of the developer housing.

The electrode structure 42 is comprised of one or more thin (i.e. 50 to 100 micron diameter) conductive wires which are lightly positioned against the toner on the donor structure 40. The distance between the wires and the donor is self-spaced by the thickness of the toner layer, which is approximately 15 microns. The extremities of the wires are supported by blocks (not shown) at points slightly above a tangent to the donor roll surface. A suitable scavengeless development system for incorporation in the present disclosure is disclosed in U.S. Pat. No. 4,868,600 and is incorporated herein by reference. As disclosed in the '600 patent, a scavengeless development system may be conditioned to selectively develop one or the other of the two image areas (i.e. discharged and charged image areas) by the application of appropriate AC and DC voltage biases to the wires 42 and the donor roll structure 40.

According to the present disclosure, and referring again to FIG. 6, the developer unit preferably includes a DC voltage source 102 to provide proper bias to the wires 42 relative to the donor roller 40. The wires 42 receive AC voltages from sources 103 and 104. These sources may generate different frequencies, and the resultant voltage on the wire is the instantaneous sum of the AC sources 103 and 104 plus the DC source 102. AC source 103 is often chosen to have the same frequency, magnitude, and phase as AC source 96, which supplies the donor roll 40. Then, the voltage of the wires with respect to the donor roll is just the AC source 104 plus the DC source 102. AC voltage source 104 is connected to a modulator 106 for modulating its frequency. The modulated frequency alternating voltage signal from the source 104 is electrically connected to the wires 42. If the source 104 has a frequency output that can be controlled by an external voltage, the modulator 106 may be any suitable commercially available suitable device, such as one including a frequency generator.

While in the development system 38, as shown in FIG. 6, the AC voltage sources 104 and 103 and the DC voltage source 102 receive their power from the power supply 94.

The electrical sections of FIG. 6 are schematic in nature. Those skilled in the art of electronic circuits will realize there are many possible ways to connect AC and DC voltage sources to achieve the desired voltages on electrodes 42, donor roll 40, and magnetic brush roll 46.

Calculation and Usage of Gain and Offset Correction

The circuit represented by FIG. 1 of this disclosure is used to generate the required Vctrl' per expression (6).

The output of the DAC is called Vdac.

Now Vctrl' can be written as:

$$Vctrl' = Vctrl - \Delta V + Vdac. \tag{7}$$

Equating this with (6) results in:

$$Vdac = Vctrl \cdot \Delta gain_{Vctrl} + Vos_{Vctrl} + \Delta V. \tag{8}$$

In the main program 272 (FIG. 8) the microcontroller continuously makes this calculation (with the numerical equivalents), based on the momentary Vctrl voltage and the stored values of $\Delta gain_{Vctrl}$ and $Vos_{Vctrl}$. It also performs the necessary A/D and D/A conversions. Note that ΔV is a constant.

The calibration mode is used to determine $\Delta gain_{vctrl}$ and $Vos_{vctrl}$ and to store them in NVM. This is done in routine "ADJUST OUTPUT i" of the FIG. 10 flowchart. As can be seen from the flowchart, $\Delta gain_{vctrl}$ and $Vos_{vctrl}$ are determined with the byte values c and d found during the routine. When the DAC output voltages that correspond with the byte values c and d, are called C and D, equation (8) can be used for solving the two unknowns. Then it is found that:

$$\Delta gain_{vctrl} = (D - C)/4.2 \tag{9}$$

$$Vos_{vctrl} = C - 0.4\Delta gain_{vctrl} - \Delta V. \tag{10}$$

The numerical equivalents of these two values are stored in NVM, being the gain and offset correction of a particular power supply source.

As also shown in the flowchart, in this case c is found with a control voltage of 0.4V and d with a control voltage of 4.6V.

Calculation and Usage of Cross-Correction

The above section dealt with deviations within a power supply source. Now suppose that the setting of source x has an influence on the setting of source i.

Source i was adjusted according (6).

During this adjustment, source x was set at a certain control voltage, $Vctrl_x$=k Volt.

To compensate for the cross-influence of source x to source i, a function is defined according:

$$Vctrl_1'' = f(Vctrl_i', Vctrl_x). \tag{11}$$

This function represents a second modification of the control voltage, now based on the control voltage of another source (x).

Figure 12:
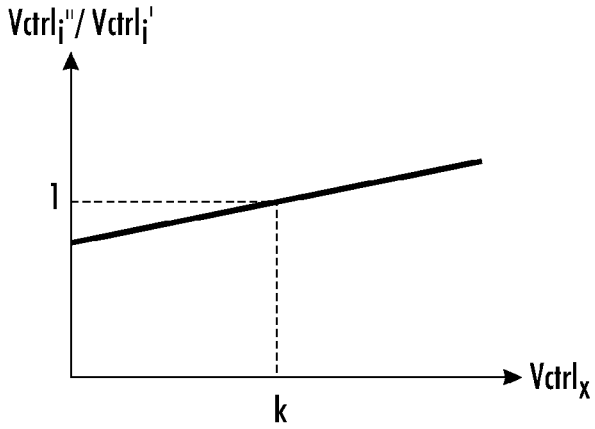
FIG. 12 is a graphical representation of $Vctrl_i''/Vctrl_i'=f(Vctrl_x)$.

For a linear dependency of $Vctrl_x$ to the ratio $Vctrl_i''/Vctrl_i'$, the Graph of FIG. 12 is valid, where $Vctrl_i''/Vctrl_i' = f(Vctrl_x)$.

The associated function is:

$$Vctrl_i'' = Vctrl'(1 + (Vctrl_x - k) \cdot xcor_i). \tag{12}$$

In the FIG. 1 implementation the DAC must again make a modification, now to $Vctrl_i'$, in order to obtain $Vctrl_i''$. If this is called $Vdac_x$, the following expression is valid:

$$Vctrl_i'' = Vctrl_i' - \Delta V + Vdac_x. \tag{13}$$

Equating (13) and (12) gives:

$$Vdac_x = Vctrl_i'(Vctrl_x - k) \cdot xcor_i + \Delta V. \tag{14}$$

With (7) this results in:

$$Vdac_x = (Vctrl_i - \Delta V + Vdac_i)(Vctrl_x - k) \cdot xcor_i + \Delta V. \tag{15}$$

Using (8) eliminates $Vdac_i$:

$$Vdac_x = (Vctrl_i \cdot (1 + \Delta gain_{Vctrli}) + Vos_{Vctrli})(Vctrl_x - k) \cdot xcor_i + \Delta V. \tag{16}$$

In the main program 272 (FIG. 8) the microcontroller continuously makes the two calculations (8) and (15) with the numerical equivalents and performs the necessary A/D and D/A conversions. The DAC output voltage will be $Vdac_i + Vdac_x$.

Equation (15) shows that $Vdac_x$ is based on the momentary $Vctrl_i$ and $Vctrl_x$ voltages, the stored value of $xcor_i$ and the $Vdac_i$ voltage, which is calculated first with (8).

The calibration mode is used to determine $xcor_i$ and to store it in NVM. This is done in routine "XADJUST OUTPUT i" of the FIG. 11 flowchart. As can be seen from the flowchart, $xcor_i$ is determined with byte value e found during the routine. When the DAC output voltage that corresponds with byte value e is called E, equation (16) can be used for solving the unknown $xcor_i$. For this, $Vdac_x$ has to be replaced by E. The result is:

$$xcor_i = (E - \Delta V)/[(Vctrl_i \cdot (1 + \Delta gain_{Vctrli}) + Vos_{Vctrli})(Vctrl_x - k)]. \tag{17}$$

With both $Vctril_i$ and $Vctrl_x$ set to 4.6V, as in the flowchart, it is found that:

$$xcor_i = (E - \Delta V)/[(4.6(1 + \Delta gain_{Vctrli}) + Vos_{Vctrli})(4.6 - k)]. \tag{18}$$

(17) and (18) show that determination of $xcor_i$ can only be done if $\Delta gain_{Vctrli}$ and $Vos_{Vctrli}$ are determined first. In other words, $Vdac_i$ must be known first. This is shown by using equation (15) for substituting E. It results in:

$$xcor_i = (E - \Delta V)/[(4.6 - \Delta V + Vdac_i)(4.6 - k)]. \tag{19}$$

Figure 7:
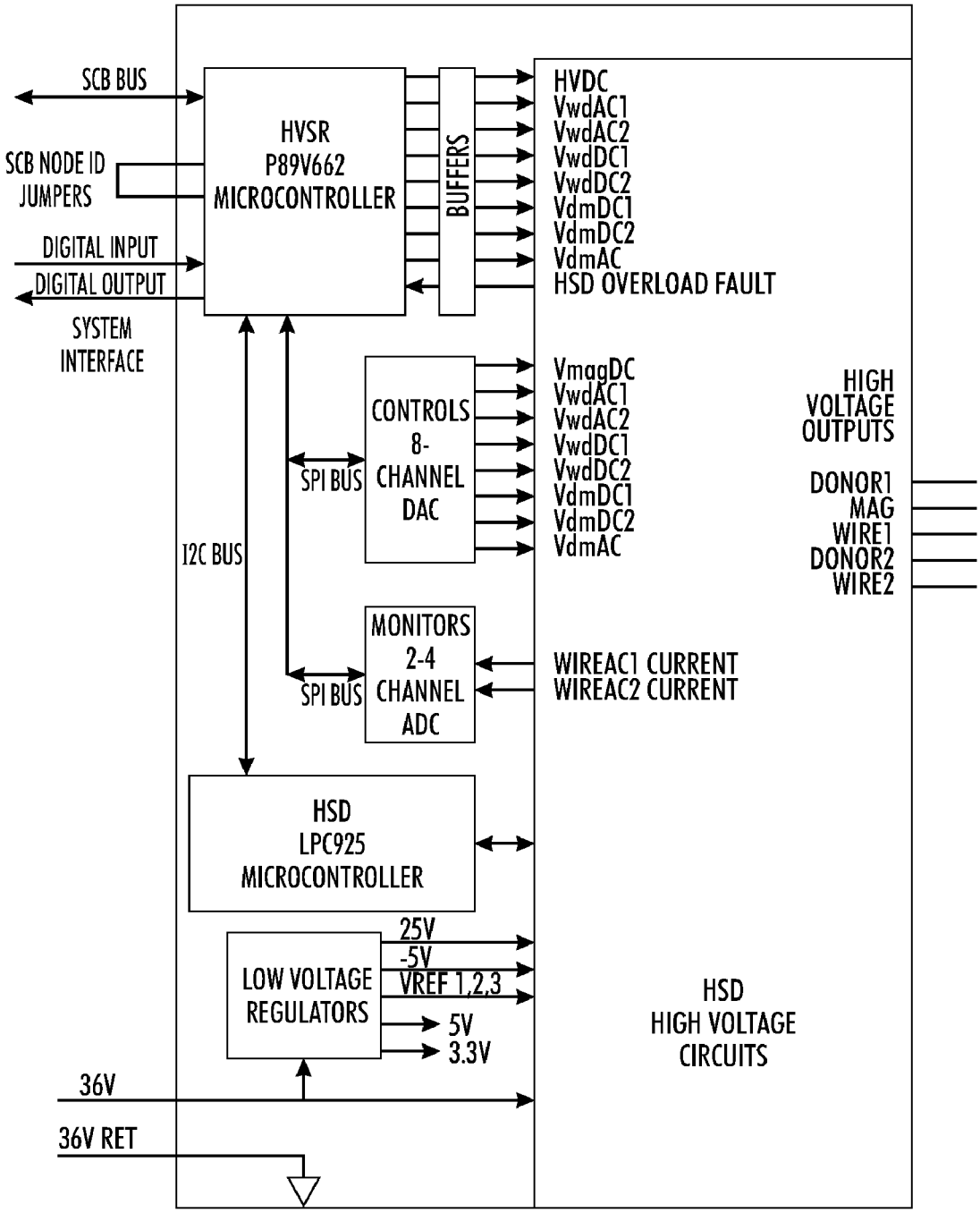
FIG. 7 is a schematical representation of a HVPS according to an exemplary embodiment of this disclosure.

With reference to FIG. 7, illustrated is a schematical representation of a HVPS according to an exemplary embodiment of this disclosure.

Figure 8:
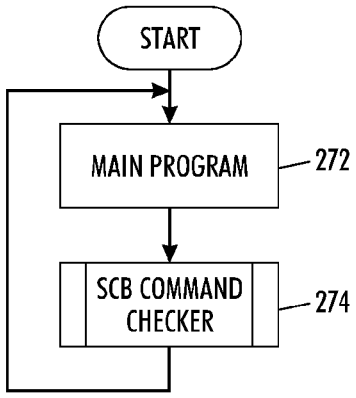
FIGS. 8, 9, 10 and 11 are flow charts illustrating an exemplary auto adjust procedure for the HVPS illustrated in FIG. 7.

With reference to FIG. 8, illustrated is a flowchart of the program stored in microcontroller 202. In the main program 272, the microcontroller 202 will calculate the required value for the DAC and will select the corresponding multiplexer channels. This is successively performed for all channels in order to make the adjustments for all output sources. This is repeated continuously because of the continuous program loop. In the loop it is also checked in subroutine 274 if there is a command received for going into calibration mode.

Figure 9:
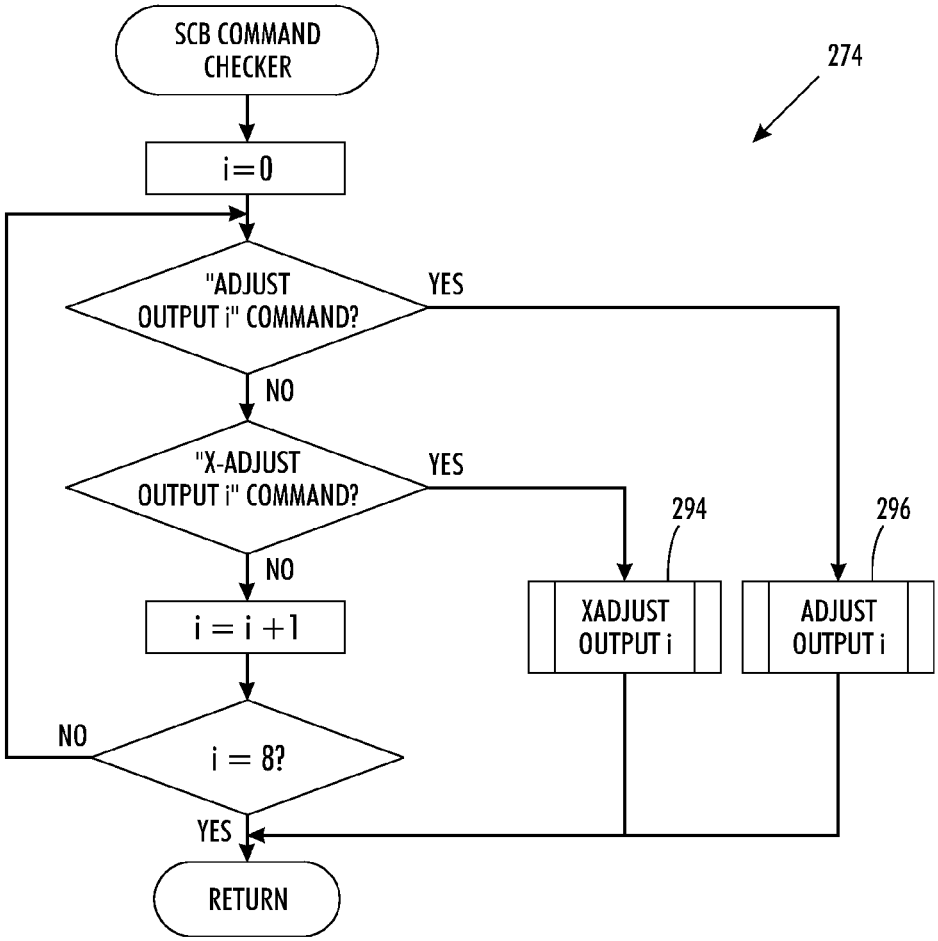

With reference to FIG. 9, illustrated is a flowchart of subroutine 274, called in the program loop to check if there is a command received for going into calibration mode for one of the output sources. In this example the number of output sources is 8. If such a command is received for output i, the respective subroutine 294 or 296 is called to perform the adjustment.

Figure 10:
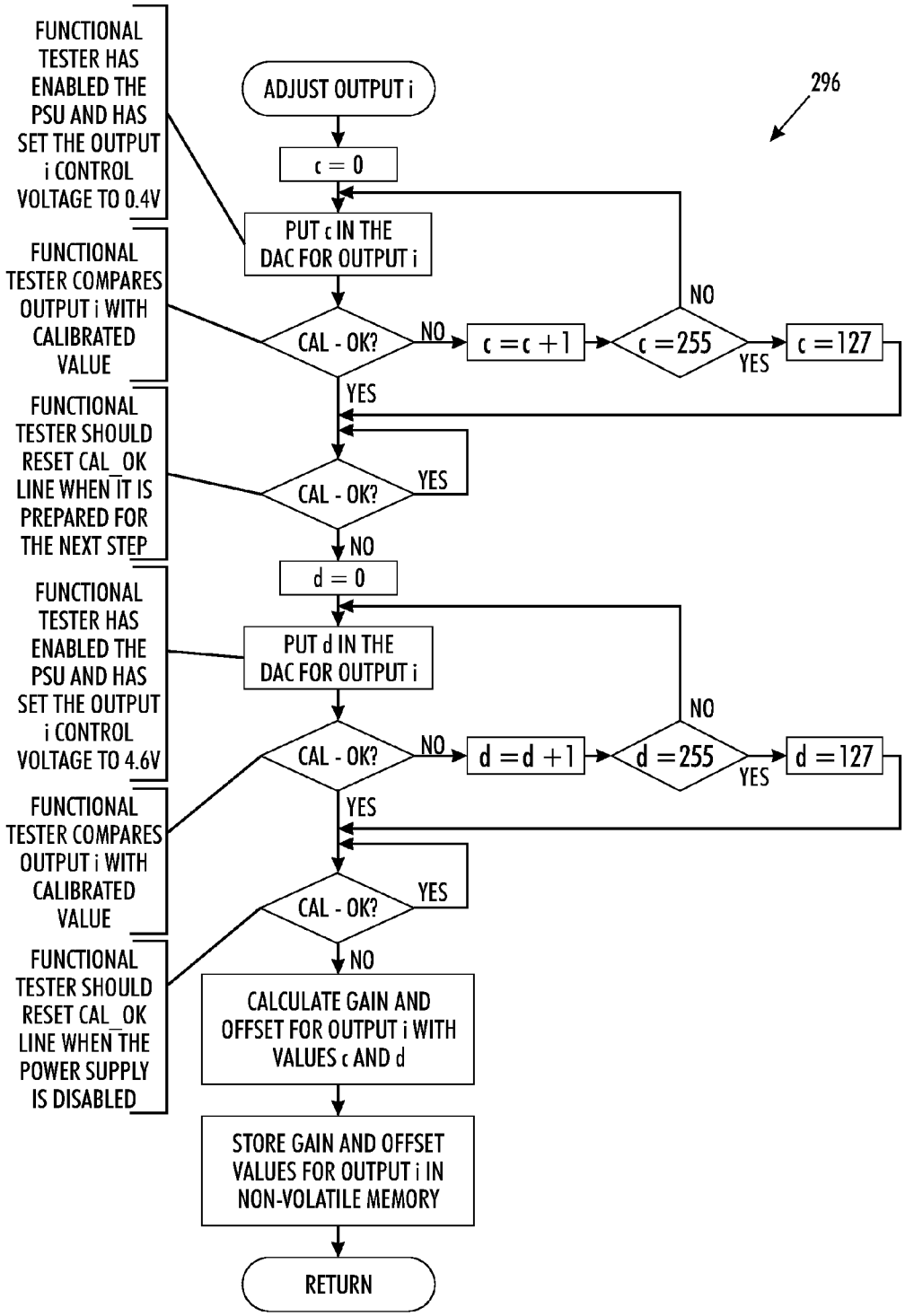

With reference to FIG. 10, illustrated is a flowchart of subroutine 296, called when the command was received to adjust output i. The adjustment means that the required gain and offset values are determined and stored in NVM (320). The process to determine these values relies on the adjustment equipment 230, which is part of the functional tester.

Figure 11:
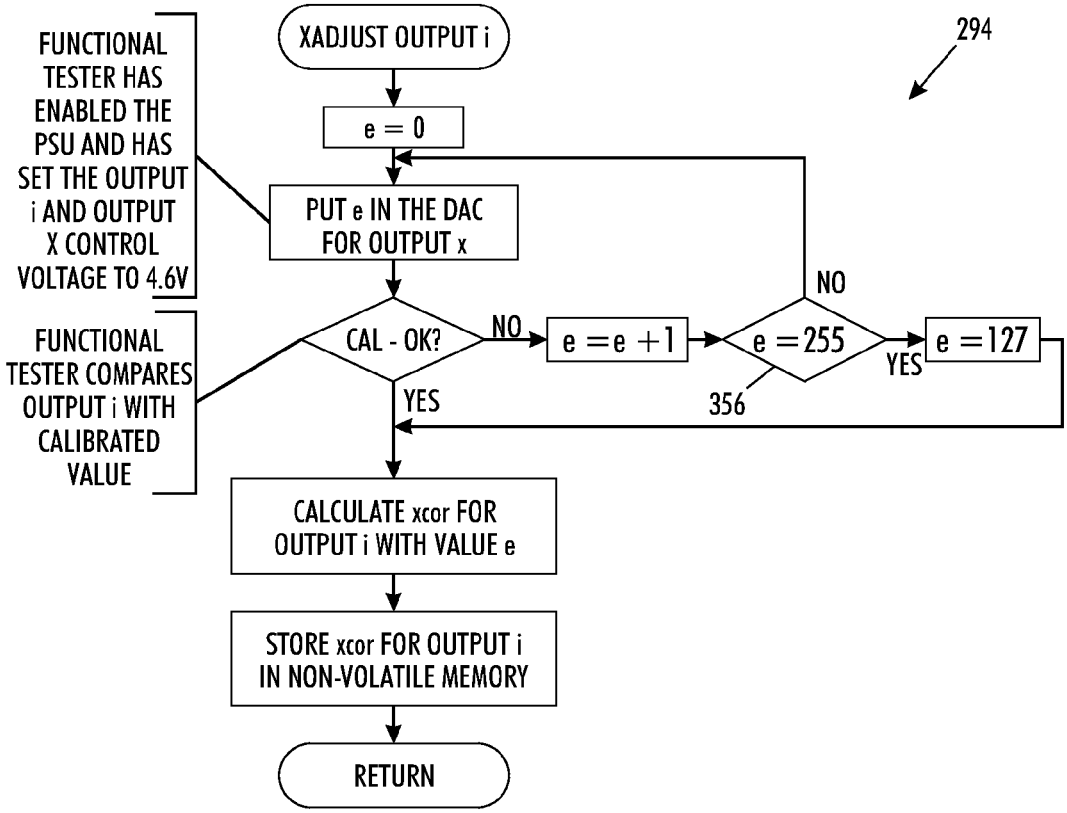

With reference to FIG. 11, illustrated is a flowchart of subroutine 294, called when the command was received to adjust output i for the cross-influence of source x. The adjustment means that the required correction value is determined and stored in NVM (350). The process to determine these values relies on the adjustment equipment 230, which is part of the functional tester.

With reference to FIG. 12, illustrated is a graphical representation of $Vctrl_i''/Vctrl_i'=f(Vctril_x)$ The correction value found with subroutine XADJUST OUTPUT i (294) resembles the slope of the straight line. The line is horizontal if there is no influence of source x to source i. When source i was adjusted in subroutine ADJUST OUTPUT i (296), source x was set at k Volt.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of operating a power supply including an analog output control input, a respective analog output associated with the analog output control input, and a non-transitory microcontroller, the microcontroller executing instructions to perform the method comprising:

a) acquiring an analog output control signal from the analog output control input, the analog output control signal representing a predetermined analog output associated with the analog output control input;

b) converting the analog output control signal to a digital output control signal;

c) generating a modified digital output control signal as a function of stored gain and offset values associated with the power supply to generate the predetermined analog output;

d) converting the modified digital output control signal to a modified analog output signal; and e) processing the modified analog output control signal to drive the power supply to generate the predetermined analog output for powering a device.

2. The method according to claim 1, wherein the analog output control signal is within a predetermined range of voltages and the analog output is within a respective predetermined range of voltages.

3. The method according to claim 2, wherein the modified digital output control signal is substantially equal to $Vctrl.(1+\Delta gain_{vctrl})+Vos_{vctrl}$, where Vctrl represents the analog output control voltage, $\Delta gain_{vctl}$ represents the stored gain associated with the respective analog output voltage, and $Vos_{vctrl}$ represents the stored offset voltage associated with the respective analog output voltage.

4. The method according to claim 1, the power supply including a plurality of analog output control inputs, a plurality of respective analog outputs, and a plurality of respective stored gains and offsets, wherein step c) generates a modified digital output control signal as a function of the stored gain and offset associated with the respective analog output.

5. The method according to claim 4, the plurality of stored gain and offset values calculated during a calibration procedure associated with the power supply, the calibration procedure performed for each analog output control input and respective analog output and the calibration procedure performing a process comprising:

a) determining a first modified digital output control signal associated with a first predetermined analog output control signal and a respective first predetermined analog output;

b) determining a second modified digital output control signal associated with a second predetermined analog output control signal and a respective second predetermined analog output;

c) calculating the gain and offset for generating the necessary modified digital output control signal to generate the predetermined analog output associated with the predetermined analog output signal.

6. The method according to claim 1, the stored gain and offset values calculated during a calibration procedure associated with the power supply, the calibration procedure performing a process comprising:

a) determining a first modified digital output control signal associated with a first predetermined analog output control signal and a respective first predetermined analog output;

b) determining a second modified digital output control signal associated with a second predetermined analog output signal and a respective second predetermined analog output;

c) calculating the gain and offset for generating the necessary modified digital output control signal to generate the predetermined analog output associated with the predetermined analog output signal.

7. The method according to claim 1, step c) comprising:

generating a modified digital output control signal as a function of stored gain, offset and cross-correction values associated with the power supply to generate the predetermined analog output.

8. The method according to claim 7, wherein the stored gain, offset and cross-correction values are generated during a calibration procedure associated with the power supply.

9. A power supply comprising:

an analog output control input;

a respective analog output associated with the analog output control input; and a microcontroller, the microcontroller configured to:

a) acquire an analog output control signal from the analog output control input, the analog output control signal representing a predetermined analog output associated with the analog output control input;

b) convert the analog output control signal to a digital output control signal;

c) generate a modified digital output control signal as a function of stored gain and offset values associated with the power supply to generate the predetermined analog output;

d) convert the modified digital output control signal to a modified analog output signal; and e) process the modified analog output control signal to drive the power supply to generate the predetermined analog output for powering a device.

10. The power supply according to claim 9, wherein the analog output control signal is within a predetermined range of voltages and the analog output is within a respective predetermined range of voltages.

11. The power supply according to claim 10, wherein the modified digital output control signal is substantially equal to $Vctrl.(1+\Delta gain_{vctrl})+Vos_{vctrl}$, where Vctrl represents the analog output control voltage, $\Delta gain_{vctrl}$ represents the stored gain associated with the respective analog output voltage, and $Vos_{vctrl}$ represents the stored offset voltage associated with the respective analog output voltage.

12. The power supply according to claim 9, the power supply including a plurality of analog output control inputs, a plurality of respective analog outputs, and a plurality of respective stored gains and offsets, wherein step c) generates a modified digital output control signal as a function of the stored gain and offset associated with the respective analog output.

13. The power supply according to claim 12, the plurality of stored gain and offset values calculated during a calibration procedure associated with the power supply, the calibration procedure performed for each analog output control input and respective analog output and the calibration procedure configured to:

a) determine a first modified digital output control signal associated with a first predetermined analog output control signal and a respective first predetermined analog output;

b) determine a second modified digital output control signal associated with a second predetermined analog output control signal and a respective second predetermined analog output;

c) calculate the gain and offset for generating the necessary modified digital output control signal to generate the predetermined analog output associated with the predetermined analog output signal.

14. The power supply according to claim 9, the stored gain and offset values calculated during a calibration procedure associated with the power supply, the calibration procedure configured to:

a) determine a first modified digital output control signal associated with a first predetermined analog output control signal and a respective first predetermined analog output;

b) determine a second modified digital output control signal associated with a second predetermined analog output signal and a respective second predetermined analog output;

c) calculate the gain and offset for generating the necessary modified digital output control signal to generate the predetermined analog output associated with the predetermined analog output signal.

15. The power supply according to claim 9, step c) comprising:

generating a modified digital output control signal as a function of stored gain, offset and cross-correction values associated with the power supply to generate the predetermined analog output.

16. The power supply according to claim 15, wherein the stored gain, offset and cross-correction values are generated during a calibration procedure associated with the power supply.

17. A xerographic printing apparatus comprising:

a photo receptor;

a ROS, the ROS configured to generate an electrostatic image on the photo receptor;

a developer unit, the developer unit configured to transfer toner to the electrostatic image on the photo receptor; and a power supply operatively connected to the developer unit, wherein the power supply is configured to supply a range of voltages to the developer unit to transfer the toner to the photo receptor, and the power supply includes an analog output control input, a respective analog output associated with the analog output control input, and a non-transitory microcontroller, the microcontroller configured to:

a) acquire an analog output control signal from the analog output control input, the analog output control signal representing a predetermined analog output associated with the analog output control input;

b) convert the analog output control signal to a digital output control signal;

c) generate a modified digital output control signal as a function of stored gain and offset values associated with the power supply to generate the predetermined analog output;

d) convert the modified digital output control signal to a modified analog output signal; and e) process the modified analog output control signal to drive the power supply to generate the predetermined analog output for powering a device.

18. The xerographic printing apparatus according to claim 17, wherein wherein the analog output control signal is within a predetermined range of voltages and the analog output is within a respective predetermined range of voltages.

19. The xerographic printing apparatus according to claim 18, wherein the modified digital output control signal is substantially equal to $Vctrl.(1+\Delta gain_{vctrl})+Vos_{vctrl}$, where Vctrl represents the analog output control voltage, $\Delta gain_{vctrl}$ represents the stored gain associated with the respective analog output voltage, and $Vos_{vctrl}$ represents the stored offset voltage associated with the respective analog output voltage.

20. The xerographic printing apparatus according to claim 17, step c) comprising:

generating a modified digital output control signal as a function of stored gain, offset and cross-correction values associated with the power supply to generate the predetermined analog output.

* * * * *